US009288597B2

(12) United States Patent
Carlsson et al.

(10) Patent No.: US 9,288,597 B2
(45) Date of Patent: Mar. 15, 2016

(54) DISTRIBUTED WIRELESS SPEAKER SYSTEM WITH AUTOMATIC CONFIGURATION DETERMINATION WHEN NEW SPEAKERS ARE ADDED

(71) Applicant: SONY CORPORATION, Tokyo (JP)

(72) Inventors: Gregory Peter Carlsson, Santee, CA (US); Steven Martin Richman, San Diego, CA (US); James R. Milne, Ramona, CA (US)

(73) Assignee: Sony Corporation, Tokyo (JP)

( * ) Notice: Subject to any disclaimer, the term of this patent is extended or adjusted under 35 U.S.C. 154(b) by 216 days.

(21) Appl. No.: 14/159,155

(22) Filed: Jan. 20, 2014

(65) Prior Publication Data

US 2015/0208188 A1 Jul. 23, 2015

(51) Int. Cl.

| | |
|---|---|
| ***H04R 29/00*** | (2006.01) |
| ***H04R 5/02*** | (2006.01) |
| ***H04R 1/00*** | (2006.01) |
| ***H04S 7/00*** | (2006.01) |
| *H04R 27/00* | (2006.01) |

(52) U.S. Cl.

CPC ..... *H04R 29/001* (2013.01); *H04R 1/00* (2013.01); *H04S 7/301* (2013.01); *H04R 27/00* (2013.01); *H04R 2227/003* (2013.01); *H04R 2420/07* (2013.01)

(58) Field of Classification Search

CPC ... H04R 29/001; H04R 2420/07; H04S 7/301
USPC ..... 381/58, 59, 300, 303–305
See application file for complete search history.

(56) References Cited

U.S. PATENT DOCUMENTS

| | | | |
|---|---|---|---|
| 6,008,777 | A | 12/1999 | Yiu |
| 7,085,387 | B1 | 8/2006 | Metcalf |
| 7,191,023 | B2 | 3/2007 | Williams |
| 7,689,613 | B2 | 3/2010 | Candelore |
| 7,822,835 | B2 | 10/2010 | Atkinson et al. |
| 8,068,095 | B2 | 11/2011 | Pryor |
| 8,077,873 | B2 | 12/2011 | Shridhar et al. |
| 8,079,055 | B2 | 12/2011 | Hardacker et al. |
| 8,179,755 | B2 | 5/2012 | Harris |
| 8,296,808 | B2 | 10/2012 | Hardacker et al. |
| 8,320,674 | B2 | 11/2012 | Guillou et al. |
| 8,438,589 | B2 | 5/2013 | Candelore |

(Continued)

FOREIGN PATENT DOCUMENTS

| | | | |
|---|---|---|---|
| WO | 2009002292 | A1 | 12/2008 |
| WO | 2012164444 | A1 | 12/2012 |

OTHER PUBLICATIONS

Frieder Ganz, Payam Barnaghi, Francois Carrez, Klaus Moessner, "Context-Aware Management for Sensor Networks", University of Surrey, Guildford, UK publication 2011.

(Continued)

*Primary Examiner* — Paul S Kim
*Assistant Examiner* — Katherine Faley
(74) *Attorney, Agent, or Firm* — John L. Rogitz

(57) ABSTRACT

In an audio speaker network, setup of speaker location, sound track or channel assignation, and speaker parameters is facilitated by an application detecting speaker locations and prompting a user to input rough room boundaries and a desired listener location in the room. Based on this, optimum speaker locations/frequency assignations/speaker parameters may be determined and output.

13 Claims, 10 Drawing Sheets

(56) References Cited

U.S. PATENT DOCUMENTS

| | | | | |
|---|---|---|---|---|
| 8,509,463 | B2 | 8/2013 | Goh et al. | |
| 8,553,898 | B2 | 10/2013 | Raftery | |
| 8,614,668 | B2 | 12/2013 | Pryor | |
| 8,621,498 | B2 | 12/2013 | Candelore | |
| 8,629,942 | B2 | 1/2014 | Candelore | |
| 8,811,630 | B2 | 8/2014 | Burlingame | |
| 2001/0037499 | A1 | 11/2001 | Turock et al. | |
| 2002/0054206 | A1 | 5/2002 | Allen | |
| 2002/0122137 | A1 | 9/2002 | Chen et al. | |
| 2002/0136414 | A1* | 9/2002 | Jordan | H04S 3/00 381/58 |
| 2003/0046685 | A1 | 3/2003 | Srinivasan et al. | |
| 2003/0107677 | A1 | 6/2003 | Lu et al. | |
| 2003/0210337 | A1 | 11/2003 | Hall | |
| 2004/0030425 | A1 | 2/2004 | Yeakel et al. | |
| 2004/0068752 | A1 | 4/2004 | Parker | |
| 2004/0264704 | A1* | 12/2004 | Huin | H04S 7/301 381/59 |
| 2005/0024324 | A1 | 2/2005 | Tomasi et al. | |
| 2005/0125820 | A1 | 6/2005 | Nelson et al. | |
| 2005/0177256 | A1* | 8/2005 | Shintani | H04R 27/00 700/94 |
| 2006/0195866 | A1 | 8/2006 | Thukral | |
| 2006/0285697 | A1 | 12/2006 | Nishikawa et al. | |
| 2008/0002836 | A1* | 1/2008 | Moeller | G10K 11/175 381/73.1 |
| 2008/0025535 | A1 | 1/2008 | Rajapakse | |
| 2008/0207115 | A1 | 8/2008 | Lee et al. | |
| 2008/0259222 | A1 | 10/2008 | Hardacker et al. | |
| 2008/0279453 | A1 | 11/2008 | Candelore | |
| 2008/0304677 | A1 | 12/2008 | Abolfathi et al. | |
| 2008/0313670 | A1 | 12/2008 | Ho et al. | |
| 2009/0037951 | A1 | 2/2009 | Candelore et al. | |
| 2009/0041418 | A1 | 2/2009 | Candelore et al. | |
| 2009/0150569 | A1 | 6/2009 | Kumar et al. | |
| 2009/0172744 | A1 | 7/2009 | Rothschild | |
| 2009/0313675 | A1 | 12/2009 | Howarter et al. | |
| 2010/0260348 | A1 | 10/2010 | Bhow et al. | |
| 2011/0091055 | A1* | 4/2011 | LeBlanc | H04S 7/301 381/303 |
| 2011/0157467 | A1 | 6/2011 | McRae | |
| 2012/0011550 | A1 | 1/2012 | Holland | |
| 2012/0058727 | A1 | 3/2012 | Cook et al. | |
| 2012/0114151 | A1 | 5/2012 | Nguyen et al. | |
| 2012/0117502 | A1 | 5/2012 | Nguyen et al. | |
| 2012/0148075 | A1 | 6/2012 | Goh et al. | |
| 2012/0158972 | A1 | 6/2012 | Gammill et al. | |
| 2012/0174155 | A1 | 7/2012 | Mowrey et al. | |
| 2012/0220224 | A1 | 8/2012 | Walker | |
| 2012/0254931 | A1 | 10/2012 | Oztaskent et al. | |
| 2012/0291072 | A1 | 11/2012 | Maddison et al. | |
| 2012/0320278 | A1 | 12/2012 | Yoshitani et al. | |
| 2013/0003822 | A1 | 1/2013 | Margulis | |
| 2013/0042292 | A1 | 2/2013 | Buff et al. | |
| 2013/0052997 | A1 | 2/2013 | Killick et al. | |
| 2013/0055323 | A1 | 2/2013 | Venkitaraman et al. | |
| 2013/0109371 | A1 | 5/2013 | Brogan et al. | |
| 2013/0156212 | A1 | 6/2013 | Bjelosevic et al. | |
| 2013/0191753 | A1 | 7/2013 | Sugiyama et al. | |
| 2013/0205319 | A1 | 8/2013 | Sinha et al. | |
| 2013/0210353 | A1 | 8/2013 | Ling et al. | |
| 2013/0223279 | A1 | 8/2013 | Tinnakornsrisuphap et al. | |
| 2013/0229577 | A1 | 9/2013 | McRae | |
| 2013/0237156 | A1 | 9/2013 | Jung et al. | |
| 2013/0238538 | A1 | 9/2013 | Cook et al. | |
| 2013/0249791 | A1 | 9/2013 | Pryor | |
| 2013/0298179 | A1 | 11/2013 | Baum et al. | |
| 2013/0309971 | A1 | 11/2013 | Kiukkonen et al. | |
| 2013/0310064 | A1 | 11/2013 | Brachet et al. | |
| 2013/0312018 | A1 | 11/2013 | Elliott et al. | |
| 2013/0317905 | A1 | 11/2013 | Warner et al. | |
| 2013/0321268 | A1 | 12/2013 | Tuck et al. | |
| 2013/0325396 | A1 | 12/2013 | Yuen et al. | |
| 2013/0325954 | A1 | 12/2013 | Cupola et al. | |
| 2013/0326552 | A1 | 12/2013 | Adams | |
| 2013/0332957 | A1 | 12/2013 | DeWeese et al. | |
| 2014/0004934 | A1 | 1/2014 | Peterson et al. | |
| 2014/0009476 | A1 | 1/2014 | Venkitaraman et al. | |
| 2014/0011448 | A1 | 1/2014 | Yang | |
| 2014/0026193 | A1 | 1/2014 | Saxman et al. | |
| 2014/0064492 | A1* | 3/2014 | Lakkundi | H04R 3/14 381/17 |

OTHER PUBLICATIONS

Sokratis Kartakis, Margherita Antona, Constantine Stephandis, "Control Smart Homes Easily with Simple Touch", University of Crete, Crete, GR, published 2011.

"Method and System for Discovery and Configuration of Wi-Fi Speakers", http://ip.com/IPCOM/000220175; Dec. 31, 2008.

Gregory Peter Carlsson, Keith Resch, Oscar Manuel Vega, "Networked Speaker System with Follow Me", file history of related U.S. Appl. No. 14/199,137, filed Mar. 6, 2014.

Gregory Peter Carlsson, Steven Martin Richman, James R. Milne, "Distributed Wireless Speaker System", file history of related U.S. Appl. No. 14/158,396, filed Jan. 17, 2014.

James R. Milne, Gregory Peter Carlsson, Steven Martin Richman, Frederick J. Zustak, "Audio Speaker System with Virtual Music Performance", file history of related pending U.S. Appl. No. 14/163,415, filed Jan. 24, 2014.

Gregory Peter Carlsson, Frederick J. Zustak, Steven Martin Richman, James R. Milne, "Wireless Speaker System with Distributed Low (Bass) Frequency", file history of related pending U.S. Appl. No. 14/163,213, filed Jan. 24, 2014.

Gregory Peter Carlsson, Frederick J. Zustak, Steven Martin Richman, James R. Milne, "Wireless Speaker System with Noise Cancelation", File History of related pending U.S. Appl. No. 14/163,089, filed Jan. 24, 2014.

Gregory Peter Carlsson, James R. Milne, Steven Martin Richman, Frederick J. Zustak, "Distributed Wireless Speaker System with Light Show", file history of related pending U.S. Appl. No. 14/163,542, filed Jan. 24, 2014.

* cited by examiner

Networked-Speaker Block Diagram

Networked-Speaker System - Scalable and Reconfigurable

Networked-Speaker System Speaker Locations

DISTRIBUTED WIRELESS SPEAKER SYSTEM WITH AUTOMATIC CONFIGURATION DETERMINATION WHEN NEW SPEAKERS ARE ADDED

I. FIELD OF THE INVENTION

The present application relates generally to distributed wireless speaker systems.

II. BACKGROUND OF THE INVENTION

People who enjoy high quality sound, for example in home entertainment systems, prefer to use multiple speakers for providing stereo, surround sound, and other high fidelity sound. As understood herein, optimizing speaker settings for the particular room and speaker location in that room does not lend itself to easy accomplishment by non-technical users, who moreover can complicate initially established settings by moving, speakers around.

SUMMARY OF THE INVENTION

Present principles provide a flexible networked (wired or wireless) speaker system which can use a network address such as a media access control (MAC) address of each individual speaker and signal strength (in wireless case) or using ultra wide band (UWB) to aid in setup and configuration of the system. Additionally, the system can detect movement of a speaker (via the switch/hub it's connected to or the signal strength) and adjust accordingly with or without user input (user may be prompted to confirm change).

The system control application knows the number of speakers present in the network. The audio signal sent to each speaker may be adjusted accordingly. For example, in a system with one speaker, stereo signal is sent to it. If there are two speakers, depending on the location, either stereo or left and right signals are sent to each speaker respectively. If one speaker is in the front of an enclosure such as a room, one is in the back, the front may be sent left and right sound tracks and the rear may be sent surround left and right. The system is scalable to 5.1, 7.1, 9.1, or any channel configuration.

Optionally, using provided microphone and phone/tablet a test signal is played to determine the level and distance from the listening position. The user can be prompted to adjust speaker locations to optimize physically. If the user cannot optimize fully, delays are introduced to achieve the optimum simulated equidistant condition relative to the listening position. Room correction can also be implemented.

A better user system setup experience is thus created by utilizing networked speakers. Users of existing systems do not receive in-depth guidance or have optimization knowledge on configuration of their multi-channel (surround sound) and/or multi-room audio systems. Present principles may be applied to facilitate easier setup of wireless surround sound and multi-room audio systems that are currently available, such as Sonos, Phorus, WiSA, etc.

With respect to the system test, a tone or indicator can confirm appropriate speaker placement, with MAC address being associated with speaker placement and if desired visually presented on a network. Furthermore, knowing where center channel is, the system can adjust time alignment/delays. A microphone can be used to measure speaker/room system to facilitate accurate setup. The output of the system may be a network map illustrating locations for speaker placement for optimum performance taking into account speaker and room characteristics. If optimal placement is not achieved, the system compensates as best it can by, e.g., allocating frequency bands, adjusting speaker parameters such as EQ, delays, etc. A configuration may be saved, enabling the system to be temporarily scaled down and then restored. For example, the user can remove one or more speakers to be used in another location and later return to the original configuration. The system can be scaled up and re-optimized as the user adds speakers. If speaker placement is modified on the setup application, the system can adjust parameters accordingly. Listener placement can be indicated by the user and the system in response can modify the speaker configuration to thereby modify the sound field to accommodate and optimize for both position and number of listeners. The computation of speaker configuration can be executed locally on the device running the application or by a network server. For example, in a multi-channel system, the rear or rear-side speakers may be removed and placed in another room. The system can automatically detect the change and adjust the configuration of the multi-channel system accordingly. Additionally, the signal to the speakers moved to another room can also be re-configured to stereo or a stereo pair.

Accordingly, a device includes at least one computer readable storage medium bearing instructions executable by a processor, and at least one processor configured for accessing the computer readable storage medium to execute the instructions to configure the processor for determining that one or more audio speakers are present on a network of audio speakers in a speaker arrangement. Each speaker is associated with a respective network address so that each speaker may be addressed by a computer accessing the network. The processor when executing the instructions is configured for prompting a user to input dimensions of at least one enclosure in which the network at least partially is disposed, and for prompting the user to input at least a desired listening position and/or a number of listeners on which the acoustic model is to be based. The processor when executing the instructions is configured for determining whether the speaker arrangement meets at least one acoustic requirement. Responsive to a determination that the speaker arrangement does not meet the acoustic requirement, the processor when executing the instructions is configured for indicating to the user that the speaker arrangement does not meet the acoustic requirement and prompting the user to adjust one or more of speaker location, orientation, frequency assignation, speaker parameters.

In example embodiments the processor when executing the instructions is further configured for, responsive to a determination that the speaker arrangement meets the acoustic requirement, establishing at least one speaker delay and/or volume based at least in part on the speaker arrangement. If desired, the processor when executing the instructions may be configured for determining whether a basic setup is complete, and responsive to a determination that the basic setup is complete, launching a speaker control interface. In non-limiting examples the processor when executing the instructions is further configured for, responsive to a determination that the basic setup is not complete, determining whether one or more measurement microphones are available, and responsive to determining that one or more measurement microphones are available, outputting an interface guiding a user through a measurement routine. The measurement routine may include causing at least one speaker to emit a test chirp, and determining a location of at least one speaker and/or at least one surface distanced from a speaker based at least in part on the test chirp.

In some example embodiments the processor when executing the instructions is further configured for determining whether at least one speaker is to be used for multiple spaces, and responsive to a determination that the at least one speaker is to be used for multiple spaces, guiding a user through secondary assignments for the at least one speaker. In some example embodiments the processor when executing the instructions is further configured for receiving user input respective labels for each speaker. The determining whether the speaker arrangement meets at least one acoustic requirement may be executed at least in part using wave interference analysis.

In another aspect, a method includes presenting, on a video display, a user interface (UI), and receiving input by way of the UI. The UI includes at least one prompt to indicate at least one boundary of an enclosure in which an audio speaker network is to be used. The UI also prompts to indicate at least one location in the enclosure of a listener of the audio speaker network.

In another aspect, a system includes at least one computer readable storage medium bearing instructions executable by a processor which is configured for accessing the computer readable storage medium to execute the instructions to configure the processor for presenting on a display at least one user interface (UI), and receiving from the UI at least one user input. The UI includes an indication of a boundary of an enclosure for containing an audio speaker network, and indications of speaker locations within the boundary.

The details of the present application, both as to its structure and operation, can be best understood in reference to the accompanying drawings, in which like reference numerals refer to like parts, and in which:

DETAILED DESCRIPTION OF THE PREFERRED EMBODIMENT

Figure 1:
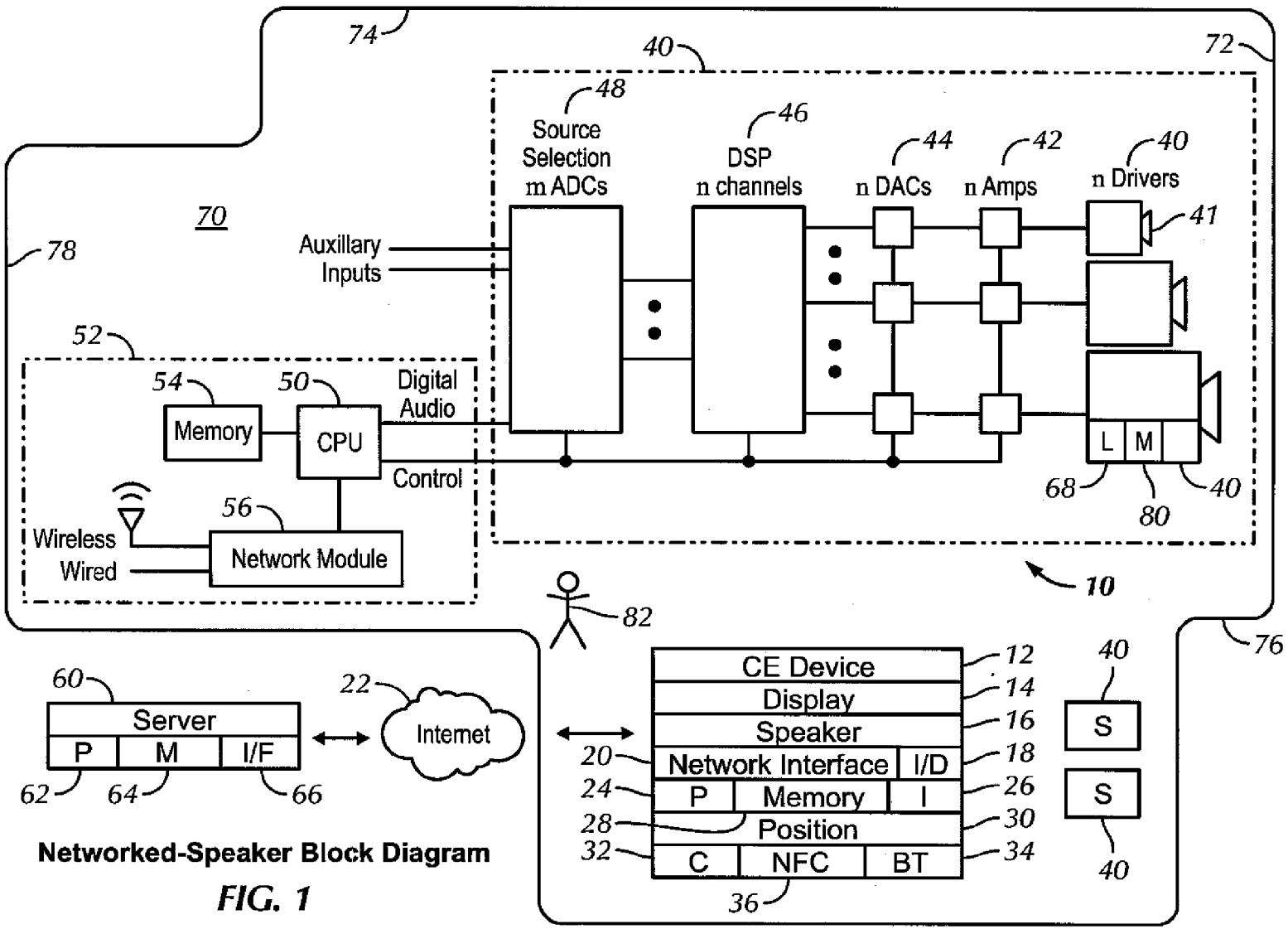
FIG. 1 is a block diagram of an example system including an example in accordance with present principles.

This disclosure relates generally to computer ecosystems including aspects of multiple audio speaker ecosystems. A system herein may include server and client components, connected over a network such that data may be exchanged between the client and server components. The client components may include one or more computing devices that have audio speakers including audio speaker assemblies per se but also including speaker-bearing devices such as portable televisions (e.g. smart TVs, Internet-enabled TVs), portable computers such as laptops and tablet computers, and other mobile devices including smart phones and additional examples discussed below. These client devices may operate with a variety of operating environments. For example, some of the client computers may employ, as examples, operating systems from Microsoft, or a Unix operating system, or operating systems produced by Apple Computer or Google. These operating environments may be used to execute one or more browsing programs, such as a browser made by Microsoft or Google or Mozilla or other browser program that can access web applications hosted by the Internet servers discussed below.

Servers may include one or more processors executing instructions that configure the servers to receive and transmit data over a network such as the Internet. Or, a client and server can be connected over a local intranet or a virtual private network.

Information may be exchanged over a network between the clients and servers. To this end and for security, servers and/or clients can include firewalls, load balancers, temporary storages, and proxies, and other network infrastructure for reliability and security. One or more servers may form an apparatus that implement methods of providing a secure community such as an online social website to network members.

As used herein, instructions refer to computer-implemented steps for processing information in the system. Instructions can be implemented in software, firmware or hardware and include any type of programmed step undertaken by components of the system.

A processor may be any conventional general purpose single- or multi-chip processor that can execute logic by means of various lines such as address lines, data lines, and control lines and registers and shift registers. A processor may be implemented by a digital signal processor (DSP), for example.

Software modules described by way of the flow charts and user interfaces herein can include various sub-routines, procedures, etc. Without limiting the disclosure, logic stated to be executed by a particular module can be redistributed to other software modules and/or combined together in a single module and/or made available in a shareable library.

Present principles described herein can be implemented as hardware, software, firmware, or combinations thereof; hence, illustrative components, blocks, modules, circuits, and steps are set forth in terms of their functionality.

Further to what has been alluded to above, logical blocks, modules, and circuits described below can be implemented or performed with a general purpose processor, a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

The functions and methods described below, when implemented in software, can be written in an appropriate language such as but not limited to C# or C++, and can be stored on or transmitted through a computer-readable storage medium such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optic and coaxial wires and digital subscriber line (DSL) and twisted pair wires. Such connections may include wireless communication connections including infrared and radio.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

Now specifically referring to FIG. 1, an example system 10 is shown, which may include one or more of the example devices mentioned above and described further below in accordance with present principles. The first of the example devices included in the system 10 is an example consumer electronics (CE) device 12. The CE device 12 may be, e.g., a computerized Internet enabled ("smart") telephone, a tablet computer, a notebook computer, a wearable computerized device such as e.g. computerized Internet-enabled watch, a computerized Internet-enabled bracelet, other computerized Internet-enabled devices, a computerized Internet-enabled music player, computerized Internet-enabled head phones, a computerized Internet-enabled implantable device such as an implantable skin device, etc., and even e.g. a computerized Internet-enabled television (TV). Regardless, it is to be understood that the CE device 12 is configured to undertake present principles (e.g. communicate with other devices to undertake present principles, execute the logic described herein, and perform any other functions and/or operations described herein).

Accordingly, to undertake such principles the CE device 12 can be established by some or all of the components shown in FIG. 1. For example, the CE device 12 can include one or more touch-enabled displays 14, one or more speakers 16 for outputting audio in accordance with present principles, and at least one additional input device 18 such as e.g. an audio receiver/microphone for e.g. entering audible commands to the CE device 12 to control the CE device 12. The example CE device 12 may also include one or more network interfaces 20 for communication over at least one network 22 such as the Internet, an WAN, an LAN, etc. under control of one or more processors 24. It is to be understood that the processor 24 controls the CE device 12 to undertake present principles, including the other elements of the CE device 12 described herein such as e.g. controlling the display 14 to present images thereon and receiving input therefrom. Furthermore, note the network interface 20 may be, e.g., a wired or wireless modern or router, or other appropriate interface such as, e.g., a wireless telephony transceiver, Wi-Fi transceiver, etc.

In addition to the foregoing, the CE device 12 may also include one or more input ports 26 such as, e.g., a USB port to physically connect (e.g. using a wired connection) to another CE device and/or a headphone port to connect headphones to the CE device 12 for presentation of audio from the CE device 12 to a user through the headphones. The CE device 12 may further include one or more tangible computer readable storage medium or memory 28 such as disk-based or solid state storage. Also in some embodiments, the CE device 12 can include a position or location receiver such as but not limited to a GPS receiver and/or altimeter 30 that is configured to e.g. receive geographic position information from at least one satellite and provide the information to the processor 24 and/or determine an altitude at which the CE device 12 is disposed in conjunction with the processor 24. However, it is to be understood that that another suitable position receiver other than a GPS receiver and/or altimeter may be used in accordance with present principles to e.g. determine the location of the CE device 12 in e.g. all three dimensions.

Continuing the description of the CE device 12, in some embodiments the CE device 12 may include one or more cameras 32 that may be, e.g., a thermal imaging camera, a digital camera such as a webcam, and/or a camera integrated into the CE device 12 and controllable by the processor 24 to gather pictures/images and/or video in accordance with present principles. Also included on the CE device 12 may be a Bluetooth transceiver 34 and other Near Field Communication (NFC) element 36 for communication with other devices using Bluetooth and/or NFC technology, respectively. An example NFC element can be a radio frequency identification (RFID) element.

Further still, the CE device 12 may include one or more motion sensors (e.g., an accelerometer, gyroscope, cyclometer, magnetic sensor, infrared (IR) motion sensors such as passive IR sensors, an optical sensor, a speed and/or cadence sensor, a gesture sensor (e.g. for sensing gesture command), etc.) providing input to the processor 24. The CE device 12 may include still other sensors such as e.g. one or more climate sensors (e.g. barometers, humidity sensors, wind sensors, light sensors, temperature sensors, etc.) and/or one or more biometric sensors providing input to the processor 24. In addition to the foregoing, it is noted that in some embodiments the CE device 12 may also include a kinetic energy harvester to e.g. charge a battery (not shown) powering the CE device 12.

In some examples the CE device 12 is used to control multiple ("n", wherein "n" is an integer greater than one) speakers 40, each of which receives signals from a respective amplifier 42 over wired and/or wireless links to transduce the signal into sound. Each amplifier 42 may receive over wired and/or wireless links an analog signal that has been converted from a digital signal by a respective standalone or integral (with the amplifier) digital to analog converter (DAC) 44. The DACs 44 may receive, over respective wired and/or wireless channels, digital signals from a digital signal processor (DSP) 46 or other processing circuit. The DSP 46 may receive source selection signals over wired and/or wireless links from plural analog to digital converters (ADC) 48, which may in turn receive appropriate auxiliary signals and, from a control processor 50 of a control device 52, digital audio signals over wired and/or wireless links. The control processor 50 may access a computer memory 54 such as any of those described above and may also access a network module 56 to permit wired and/or wireless communication with, e.g., the Internet. As shown in FIG. 1, the control processor 50 may also communicate with each of the ADCs 48, DSP 46, DACs 44, and amplifiers 42 over wired and/or wireless links. The control device 52, while being shown separately from the CE device 12, may be implemented by the CE device 12. In some embodiments the CE device 12 is the control device and the CPU 50 and memory 54 are distributed in each individual speaker as individual speaker processing units. In any case, each speaker 40 can be separately addressed over a network from the other speakers.

More particularly, in some embodiments, each speaker 40 may be associated with a respective network address such as but not limited to a respective media access control (MAC) address. Thus, each speaker may be separately addressed over a network such as a local area network (LAN) and/or the Internet. Wired and/or wireless communication links may be established between the speakers 40/CPU 50, CE device 12, and server 60, with the CE device 12 and/or server 60 being thus able to address individual speakers, in some examples through the CPU 50 and/or through the DSP 46 and/or through individual processing units associated with each individual speaker 40, as may be mounted integrally in the same housing as each individual speaker 40. Thus, as alluded to above, the CPU 50 may be distributed in individual processing units in each speaker 40.

The CE device 12 and/or control device 52 (when separate from the CE device 12) and/or individual speaker trains (speaker+amplifier+DAC+DSP, for instance) may communicate over wired and/or wireless links with the Internet 22 and through the Internet 22 with one or more network servers 60. Only a single server 60 is shown in FIG. 1. A server 60 may include at least one processor 62, at least one tangible computer readable storage medium 64 such as disk-based or solid state storage, and at least one network interface 66 that, under control of the processor 62, allows for communication with the other devices of FIG. 1 over the network 22, and indeed may facilitate communication between servers and client devices in accordance with present principles. Note that the network interface 66 may be, e.g., a wired or wireless modem or router, Wi-Fi transceiver, or other appropriate interface such as, e.g., a wireless telephony transceiver.

Accordingly, in some embodiments the server 60 may be an Internet server, may include and perform "cloud" functions such that the devices of the system 10 may access a "cloud" environment via the server 60 in example embodiments. In a specific example, the server 60 downloads a software application to the CE device 12 for control of the speakers 40 according to logic below. The CE device 12 in turn can receive certain information from the speakers 40, such as their location as determined by GPS, UWB, or other technology, and/or the CE device 12 can receive input from the user, e.g., indicating the locations of the speakers 40 as further disclosed below. Based on these inputs at least in part, the CE device 12 may execute the speaker optimization logic discussed below, or it may upload the inputs to a cloud server 60 for processing of the optimization algorithms and return of optimization outputs to the CE device 12 for presentation thereof on the CE device 12, and/or the cloud server 60 may establish speaker configurations automatically by directly communicating with the speakers 40 via their respective addresses, in some cases through the CE device 12. Note that if desired, each speaker 40 may include a respective one or more lamps 68 that can be illuminated on the speaker.

Typically, the speakers 40 are disposed in an enclosure 70 such as a room, e.g., a living room. Note that each speaker or a group of speakers may themselves be located in a speaker enclosure with the room enclosure 70. For purposes of disclosure, the enclosure 70 has (with respect to the example orientation of the speakers shown in FIG. 1) a front wall 72, left and right side walls 74, 76, and a rear wall 78. One or more listeners 82 may occupy the enclosure 70 to listen to audio from the speakers 40. One or microphones 80 may be arranged in the enclosure for measuring signals representative of sound in the enclosure 70, sending those signals via wired and/or wireless links to the CPU 50 and/or the CE device 12 and/or the server 60. In the non-limiting example shown, each speaker 40 supports a microphone 80, it being understood that the one or more microphones may be arranged elsewhere in the system if desired.

Disclosure below may refer to matching speaker locations to "good" configurations or determining speaker locations based on "good" acoustics or determining noise cancelation speaker locations or other similar determinations. It is to be understood that such determinations may be made using sonic wave calculations known in the art, in which the acoustic waves frequencies (and their harmonics) from each speaker, given its role as a bass speaker, a treble speaker, a sub-woofer speaker, or other speaker characterized by having assigned to it a particular frequency band, are computationally modeled in the enclosure 70 and the locations of constructive and destructive wave interference determined based on where the speaker is and where the walls 72-78 are. As mentioned above, the computations may be executed, e.g., by the CE device 12 and/or by the cloud server 60, with results of the computations being returned to the CE device 12 for presentation thereof and/or used to automatically establish parameters of the speakers.

As an example, a speaker may emit a band of frequencies between 20 Hz and 30 kHz, and frequencies (with their harmonics) of 20 Hz, 40 Hz, and 60 Hz may be modeled to propagate in the enclosure 70 with constructive and destructive interference locations noted and recorded. The wave interference patterns of other speakers based on the modeled expected frequency assignations and the locations in the enclosure 70 of those other speakers may be similarly computationally modeled together to render an acoustic model for a particular speaker system physical layout in the enclosure 70 with a particular speaker frequency assignations. In some embodiments, reflection of sound waves from one or more of the walls 72-78 may be accounted for in determining wave interference. In other embodiments reflection of sound waves from one or more of the walls 72-78 may not be accounted for in determining wave interference. The acoustic model based on wave interference computations may furthermore account for particular speaker parameters such as but not limited to equalization (EQ) and bandwidth. The parameters may also include delays, i.e., sound track delays between speakers, which result in respective wave propagation delays relative to the waves from other speakers, which delays may also be accounted for in the modeling. A sound track delay refers to the temporal delay between emitting, using respective speakers, parallel parts of the same soundtrack, which temporally shifts the waveform pattern of the corresponding speaker. The parameters can also include volume, which defines the amplitude of the waves from a particular speaker and thus the magnitude of constructive and destructive interferences in the waveform. Collectively, a combination of speaker location, frequency assignation, and parameters may be considered to be a "configuration".

Each variable (speaker location, frequency assignation, and individual parameters) may then be computationally varied as the other variables remain static to render a different configuration having a different acoustic model. For example, one model may be generated for the speakers of a system being in respective first locations, and then a second model computed by assuming that at least one of the speakers has been moved to a second location different from its first location. Similarly, a first model may be generated for speakers of a system having a first set of frequency assignations, and then a second model may be computed by assuming that at least one of the speakers has been assigned a second frequency band or channel to transmit different from its first frequency or channel assignation. Yet again, if one speaker location/frequency assignation combination is evaluated as presenting a poor configuration, the model may introduce, speaker by speaker, a series of incremental delays, reevaluating the acoustic model for each delay increment, until a particular set of delays to render the particular speaker location/frequency assignation combination acceptable is determined. Acoustic models for any number of speaker location/frequency assignation/speaker parameter (i.e., for any number of configurations) may be calculated in this way.

Each acoustic model may then be evaluated based at least in part on the locations and/or magnitudes of the constructive and destructive interferences in that model to render one or more of the determinations/recommendations below. The evaluations may be based on heuristically-defined rules. Non-limiting examples of such rules may be that a particular configuration is evaluated as "good" if bass frequency resonance is below a threshold amplitude at a particular location, e.g., at an assumed (modeled) viewer 82 location. Another rule may be that a particular configuration is evaluated as "good" if bass frequency resonance is above a threshold amplitude at a particular location, e.g., at an assumed (modeled) viewer 82 location, and otherwise is evaluated as "bad". Another rule may be that a particular configuration is evaluated as "good" if the total mean and/or average amplitudes of all constructive interference points in the enclosure 70 exceed a threshold amplitude. Another rule may be that a particular configuration is evaluated as "good" if the mean and/or average amplitudes of all constructive interference points in the enclosure 70 are below a threshold amplitude. Another rule may be that a particular configuration is evaluated as "good" if the mean and/or average amplitudes of all destructive interference points in the enclosure 70 exceed a threshold number (e.g., for noise cancelation). Another rule may be that a particular configuration is evaluated as "good" if the mean and/or average amplitudes of all destructive interference points in the enclosure 70 are below a threshold number. Another rule may that the "best" speaker configuration is the one producing the largest area of mean constructive wave interference. Another rule may be to decrease the volume output by a bass speaker (woofer or sub-woofer) in a particular frequency band if the distance between the speaker and a wall of the enclosure 70 is within a threshold distance corresponding to constructive interference centered in the particular frequency band. Another rule may be that a speaker configuration is "good" if constructive interference in a user-defined frequency range at a default or user-defined listener location in the enclosure 70 is above a threshold.

Plural rules may be applied, with the number of "good" evaluations for a particular configuration under the plural rules being summed together and, if desired, with any "bad" evaluations for that configuration under other rules being deducted from the sum, to render a score. The configuration with the highest score may be considered the "best" configuration. Or, each "good" evaluation may be accorded a number other than one and the scores may be combined by multiplication or division and compared to a threshold that is established accordingly. In addition to multiplication/division and addition/subtraction, the scores may be combined in other ways, e.g., exponentially (as exponents in terms of an equation, for instance), trigonometrically (as coefficients or angles in sinusoidal equations, for instance), etc., with the comparison values established as appropriate for the particular mathematical manner in which the scores are combined. It is to be understood that the heuristic rules above are illustrative only and are not otherwise limiting. It is to be further understood that evaluation rules may be user-selected or user-generated.

The location of the walls 72-78 may be input by the user using, e.g., a user interface (UI) in which the user may draw, as with a finger or stylus on a touch screen display 14 of a CE device 12, the walls 72-78 and locations of the speakers 40. Or, the position of the walls may be measured by emitting chirps, including a frequency sweep of chirps, in sequence from each of the speakers 40 as detected by each of the microphones 80 and/or from the microphone 18 of the CE device 12, determining, using the formula distance=speed of sound multiplied by time until an echo is received back, the distance between the emitting microphone and the walls returning the echoes. Note in this embodiment the location of each speaker (inferred to be the same location as the associated microphone) is known as described above. By computationally modeling each measured wall position with the known speaker locations, the contour of the enclosure 70 can be approximately mapped.

Figure 2:
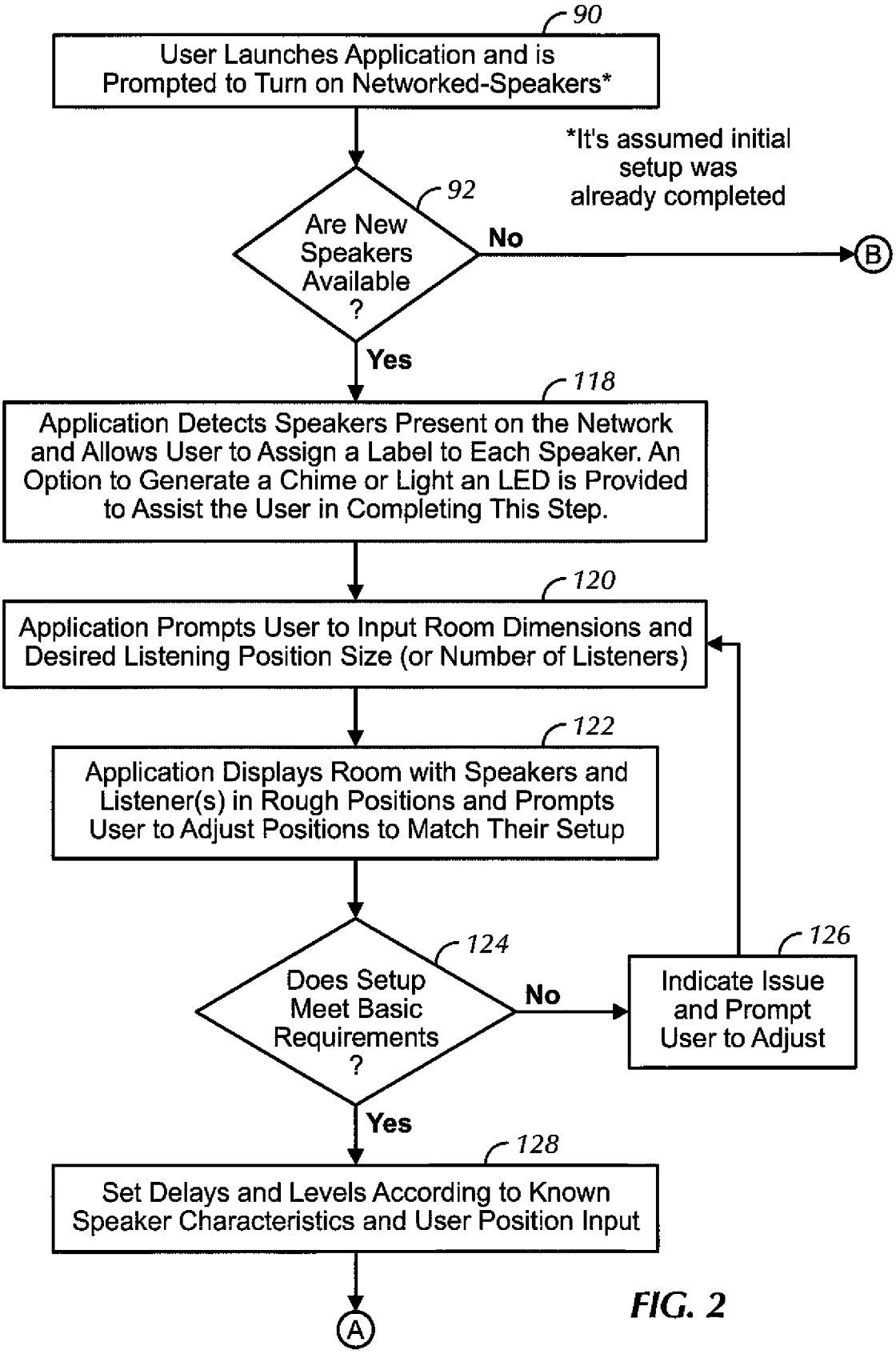
FIGS. 2, 2A, 2B, 3, and 3A, are flow charts of example logic according to present principles.
Figure 2A:
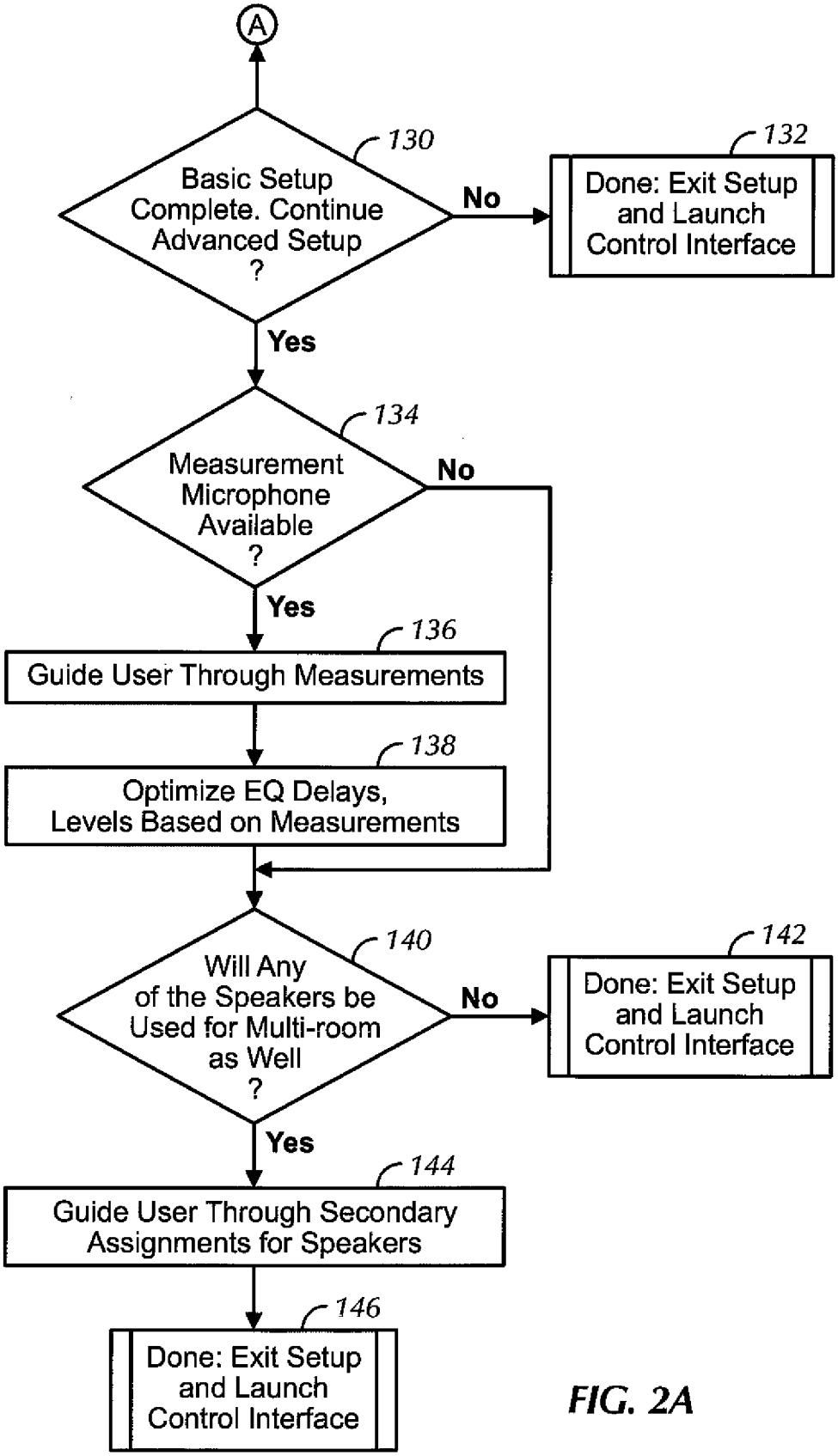
Figure 2B:
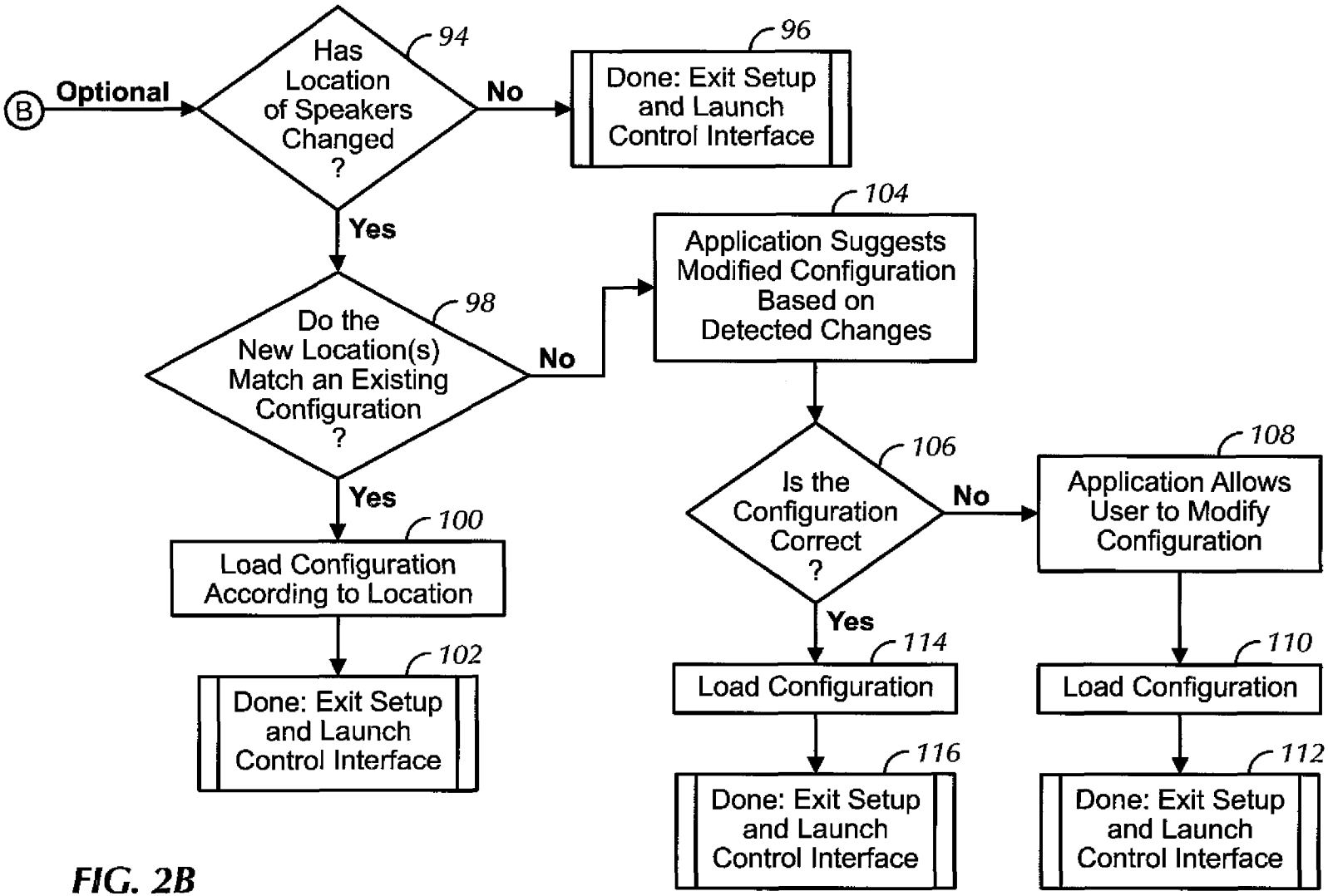
Figure 4:
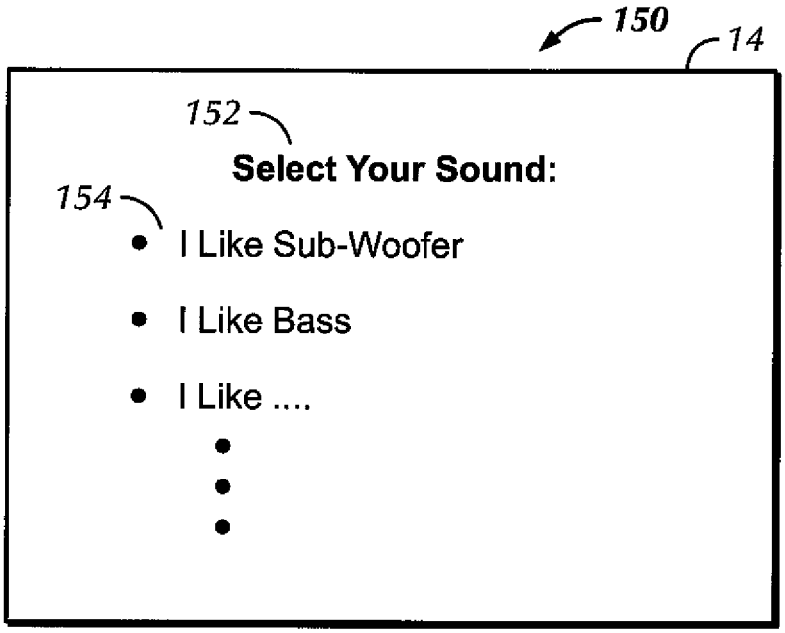
FIGS. 4-12 are example user interfaces (UI) according to present principles.

Now referring to FIGS. 2, 2A, 2B, flow charts of example logic is shown. The logic shown in the flow charts may be executed by one or more of the CPU 50, the CE device 12 processor 24, and the server 60 processor 62. The logic may be executed at application boot time when a user, e.g. by means of the CE device 12, launches a control application at block 90, which prompts the user to energize the speaker system to energize the speakers 40. The discussion of the flow charts refers from time to time to user interfaces (UI), examples of which are shown in FIG. 4 et seq.

Proceeding to decision diamond 92, which is optional in some embodiments, it is determined whether new speakers 40 are now available on the system network. To make this determination, the processor executing the logic can access a data structure indicating, by MAC address for example or by other individual speaker identification, which speakers previously were available and comparing that with reports from the networked speakers sent upon energization at block 90 along with their addresses or other identifications that accompany the reports. Optionally, if no new speakers have been added the logic proceeds to decision diamond 94. It is to be understood that the logic branch between decision diamond 94 and block 116 may be omitted in some embodiments with the logic proceeding directly from block 90 to block 118. A default list of speakers may be used for the initial execution of the application. The default list may be null.

If no new speakers have been determined to have been added at decision diamond 92, the logic can proceed to decision diamond to 94 determine whether the location of any speakers has changed since the last time the system was used. A default location may be used for the initial execution of the application. To determine speaker location, position information may be received from each speaker 40 as sensed by a global positioning satellite (GPS) receiver on the speaker, or as determined using Wi-Fi (via the speaker's MAC address, Wi-Fi signal strength, triangulation, etc. using a Wi-Fi transmitter associated with each speaker location, which may be mounted on the respective speaker) to determine speaker location. Or, the speaker location may be input by the user as discussed further below. The current position may be compared for each speaker to a data structure listing the previous position of that respective speaker to determine whether any speaker has moved.

If no speakers have been moved, the logic may exit at state 96 and launch, e.g., on the CE device 12, a speaker control interface, aspects of examples of which are discussed further below. On the other hand, if any speaker has moved, the logic moves to decision diamond 98 to determine whether the new speaker locations match locations correlated to an existing speaker configuration, it now being understood that multiple past speaker locations and associated configurations may be stored to avoid recomputing configurations when a user moves speakers but back to locations they may have been in the past.

If the new speaker locations match locations correlated to an existing speaker configuration, that existing configuration is established for the speakers at block 100, and then at block 102 the logic exits the setup mode to launch, e.g., on the CE device 12, the speaker control interface. On the other hand, if at least one of the new speaker locations does not match a location for that speaker that is correlated to an existing speaker configuration, the logic moves to block 104 to suggest a modified speaker configuration based on the detected speaker positions. This suggestion may appear as a prompt on, e.g., the CE device display 14.

It is to be understood at this point that the suggested modifications alluded to above are generated as described previously using acoustic wave interference analysis. Thus, for example, the analysis typically may be undertaken using the location of the new speaker and then multiple alternate configurations automatically computationally constructed and analyzed according to principles above using the analysis rules in effect and compared to the analysis results appertaining to the new speaker location to render one or more suggestions of "better" configurations by which to modify the speaker layout. These suggestions may be presented on the display 14 of the CE device 12 according to further description below.

As stated above, each variable of the speaker configuration (location and/or frequency assignation and/or speaker parameter) may be varied individually and incrementally to establish a series of models each of which is tested against the rules to determine whether the configuration under test is "good". A large number of models may be incrementally generated and evaluated in this way. In one example, the new speaker locations and frequency assignations are held constant, and speaker delays varied incrementally, with each combination of incremental speaker delays establishing a configuration that is evaluated until all delay increment combinations have been tested. If any configuration thus evaluated produces a "good" configuration, meaning that by simply establishing speaker delays, the user's choice of speaker location can be accommodated, an indication of that configuration may be output on the CE device 12 and/or the delays automatically established in the respective speakers 40 by separately addressing each speaker as described above. Parameters such as EQ can also be incrementally varies and modeled at each increment to determine if any combination of EQs produces a "good" configuration based on the speaker locations and listener's location. If no configuration thus evaluated produces a "good" configuration, the algorithm may next calculate models for each possible combination of frequency assignations to the various speakers 40, again holding the new speaker locations constant in the modeling. If any configuration thus evaluated by testing different frequency assignations produces a "good" configuration, meaning that by simply establishing speaker frequency assignations, the user's choice of speaker location can be accommodated, an indication of that configuration may be output on the CE device 12 and/or the frequency assignations automatically established in the respective speakers 40 by sending the assigned frequencies to the respective speakers. In this non-limiting example, only if a "good" configuration cannot be established by varying speaker parameters or frequency variations are different speaker locations then modeled to obtain a "good" speaker configuration.

From block 104, the logic may in some examples move to decision diamond 106 in which it is determined, based on user input, whether the suggested configuration is "correct", i.e., whether the user has elected to select a suggested configuration from one or more suggested configurations or whether the user has decided to modify a suggested configuration. If the user has selected to modify a configuration, one or more UIs are presented to permit the user to modify a suggested configuration at block 108. The modified configuration is implemented in the speaker system at block 110 and then at block 112 the logic exits the setup mode to launch, e.g., on the CE device 12, the speaker control interface. If the user does not select to modify a suggestion but instead selects one of the suggestions, the selected configuration is implemented in the speaker system at block 114 and then at block 116 the logic exits the setup mode to launch, e.g., on the CE device 12, the speaker control interface.

Returning to decision diamond 92, when no new speakers are sensed or in embodiments that do not account for new speakers, the logic proceeds to block 118. At block 118, the logic detects, using principles discussed previously, the speakers that are present on the network and allows the user to assign a label to each speaker. An example UI to this end is discussed below. If desired, an audible chime may be generated or a lamp such as a light emitting diode (LED) on the CE device 12 may be energized to assist the user in completing this chore. From block 118 the logic moves to block 120, in which the logic prompts the user to input room dimensions and desired listening position and/or number of listeners on which the acoustic model is to be based. Other elements may also be presented for input, including speaker parameters, speaker frequency assignation. An example UI to this end is discussed below.

From block 122 the logic moves to decision diamond 124 to determine whether the current speaker arrangement meets threshold or basic acoustic requirements. This determination may be as discussed above by wave interference analysis using heuristically defined rules that are designated to be the threshold or basic requirements to be met. If the threshold or basic requirements are not met, the logic moves to block 126 to indicate to the user, e.g., via a UI, that the present arrangement does not meet the threshold or basic requirements and to loop back to block 120 to prompt the user to adjust one or more of speaker location, orientation, frequency assignation, speaker parameters.

On the other hand, if, at decision diamond 124, it is determined that the threshold or basic requirements are met, the logic moves to block 128 to, for each speaker, establish its delay and volume based on the speaker characteristics (parameters) and the default or user-defined user location in the enclosure 70. Then, the logic moves to decision diamond 130 to determine whether a basic setup is complete, as indicated by, e.g., a user responding "yes" to a prompt on the CE device 12 inquiring whether the user wishes to exit with a basic setup, or proceed with a more advanced setup. At block 132 the logic exits the setup mode to launch, e.g., on the CE device 12, the speaker control interface responsive to input indicating the user is satisfied with the basic setup. Otherwise, the logic moves to decision diamond 134 to determine whether one or more measurement microphones, such as may be established by the microphones 80 in FIG. 1, are available. This determination may be made based on information received from the individual speakers/CPU 50 indicating microphones are on the speakers, for example.

If measurement microphones are available, the logic moves to block 136 to guide the user through a measurement routine. An example UI to this end is discussed further below. In one example, the user is guided to cause each individual speaker in the system to emit a test sound ("chirp") and/or chirp frequency sweep that the microphones 80 and/or microphone 18 of the CE device 12 detect and provide representative signals thereof to the processor or processors executing the logic, which, based on the test chirps, can adjust speaker parameters such as EQ, delays, and volume at block 138. Note that the test chirps and echoes thereof in some examples are used to establish the boundaries of the enclosure 70 for wave interference analysis purposes discussed above. This may be done as discussed previously.

From block 138 the logic may move to decision diamond 140 to determine whether any speaker is to be used for multiple spaces, i.e., used to supply audio in at least one space other than the enclosure 70. This may be determined based on user input from a UI, an example of which is described further below. If no further spaces are desired for speaker use, the logic moves to block 142 to exit and launch, e.g., on the CE device 12, the speaker control interface. However, if the user indicates that one or more speakers are to be used to also, in addition to the enclosure 70, send audio into adjoining spaces, the logic moves to block 144 to guide the user through secondary assignments for the speakers using, e.g., one or more UIs similar to the ones shown in FIGS. 4-7, 9, and 10 and discussed further below. From block 144 the logic moves to block 146 to exit and launch, e.g., on the CE device 12, the speaker control interface.

Figure 3:
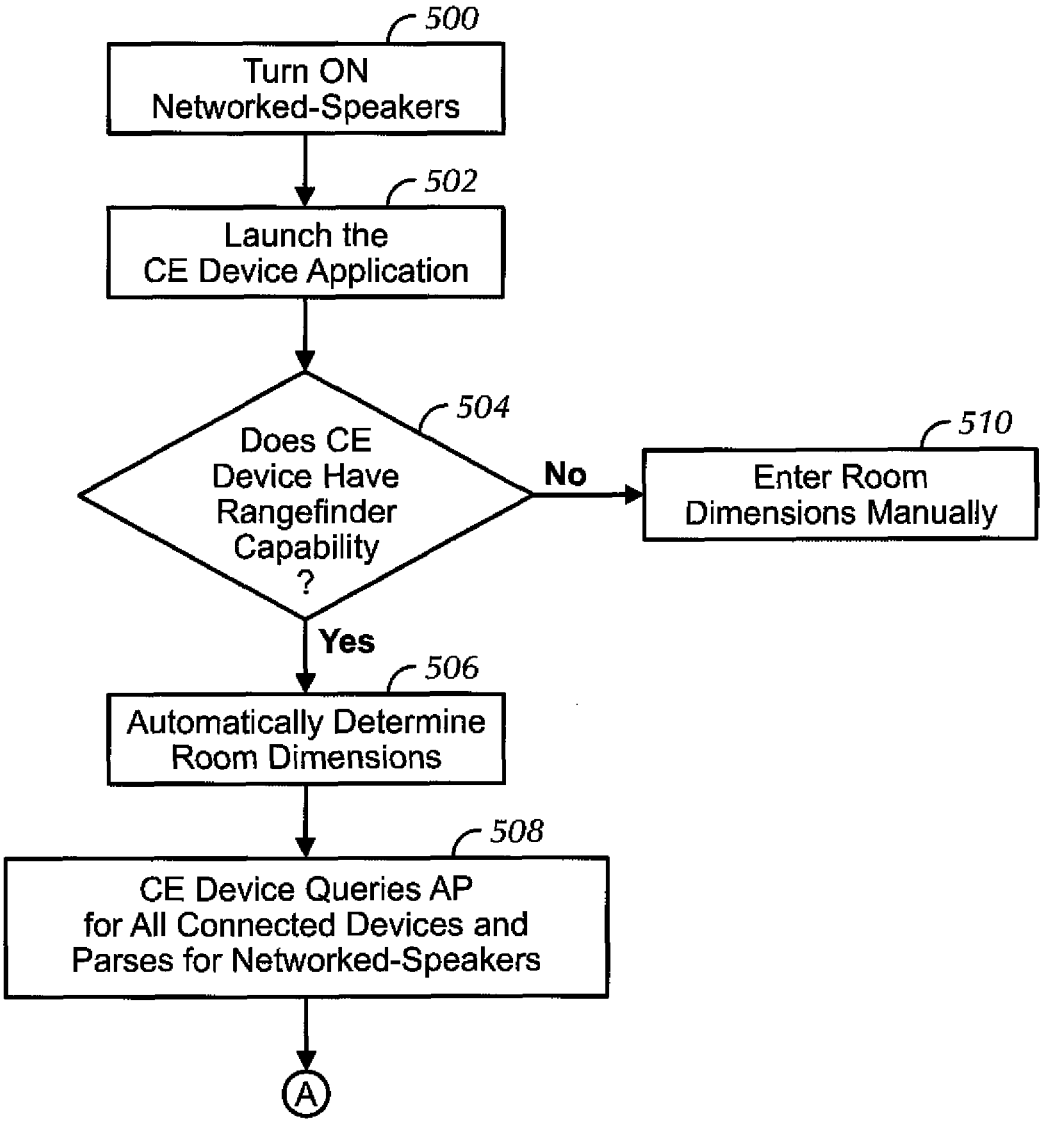
Figure 3A:
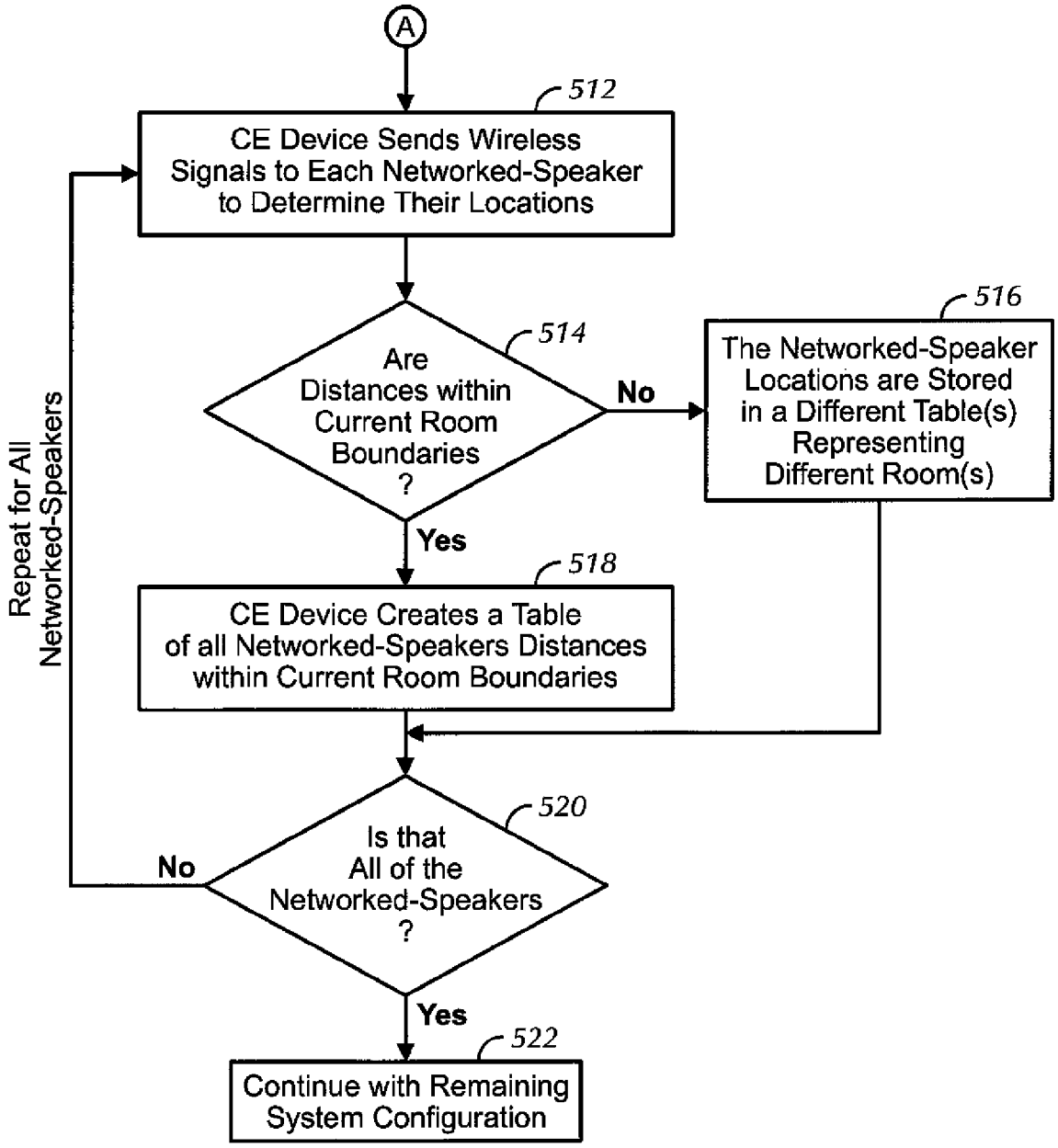

FIGS. 3 and 3A illustrate supplemental logic in addition to or in lieu of some of the logic disclosed elsewhere herein that may be employed in example non-limiting embodiments to discover and map speaker location and room (enclosure 70) boundaries. Commencing at block 500, the speakers are energized and a discovery application for executing the example logic below is launched on the CE device 12. If the CE device 12 has range finding capability at decision diamond 504, the CE device (assuming it is located in the enclosure) automatically determines the dimensions of the enclosure in which the speakers are located relative to the current location of the CE device 12 as indicated by, e.g., the GPS receiver of the CE device. Thus, not only the contours but the physical locations of the walls of the enclosure are determined. This may be executed by, for example, sending measurement waves (sonic or radio/IR) from an appropriate transceiver on the CE device 12 and detecting returned reflections from the walls of the enclosure, determining the distances between transmitted and received waves to be one half the time between transmission and reception times the speed of the relevant wave. Or, it may be executed using other principles such as imaging the walls and then using image recognition principles to convert the images into an electronic map of the enclosure.

From block 506 the logic moves to block 508, wherein the CE device queries the speakers, e.g., through a local network access point (AP), by querying for all devices on the local network to report their presence and identities, parsing the respondents to retain for present purposes only networked audio speakers. On the other hand, if the CE device does not have range finding capability the logic moves to block 510 to prompt the user of the CE device to enter the room dimensions as described elsewhere herein.

From either block 508 or block 510 the logic flows to block 512, wherein the CE device 12 sends, e.g., wirelessly via Bluetooth, Wi-Fi, or other wireless link a command for the speakers to report their locations. These locations may be obtained by each speaker, for example, from a local GPS receiver on the speaker, or a triangulation routine may be coordinated between the speakers and CE device 12 using ultra wide band (UWB) principles. UWB location techniques may be used, e.g., the techniques available from DecaWave of Ireland, to determine the locations of the speakers in the room. Some details of this technique are described in Decawave's USPP 20120120874, incorporated herein by reference. Essentially, UWB tags, in the present case mounted on the individual speaker housings, communicate via UWB with one or more UWB readers, in the present context, mounted on the CE device 12 or on network access points (APs) that in turn communicate with the CE device 12. Other techniques may be used.

The logic moves from block 512 to decision diamond 514, wherein it is determined, for each speaker, whether its location is within the enclosure boundaries determined at block 506. For speakers not located in the enclosure the logic moves to block 516 to store the identity and location of that speaker in a data structure that is separate from the data structure used at block 518 to record the identities and IDs of the speakers determined at decision diamond 514 to be within the enclosure. Each speaker location is determined by looping from decision diamond 520 back to block 512, and when no further speakers remain to be tested, the logic concludes at block 522 by continuing with any remaining system configuration tasks divulged herein.

FIG. 4 shows an example UI 150 that may be presented on the display 14 of the CE device 12 as alluded to in the discussion of analysis rules. A user may be prompted at 152 to select a particular preferred sound from a list 154 of sounds. In the example shown, the user may indicate that more, rather than less, treble is desired, and this becomes an analysis rule during the waveform analysis discussed above, in which configurations producing the most average or mean constructive interference in the treble range are output as "good" over configurations producing less constructive interference in the treble range. In the example shown, the user may indicate that more, rather than less, bass is desired, and this becomes an analysis rule during the waveform analysis discussed above, in which configurations producing the most average or mean constructive interference in the bass range are output as "good" over configurations producing less constructive interference in the bass range. In the example shown, the user may indicate that more, rather than less, woofer (deep bass) is desired, and this becomes an analysis rule during the waveform analysis discussed above, in which configurations producing the most average or mean constructive interference in the woofer range are output as "good" over configurations producing less constructive interference in the woofer range.

Figure 5:
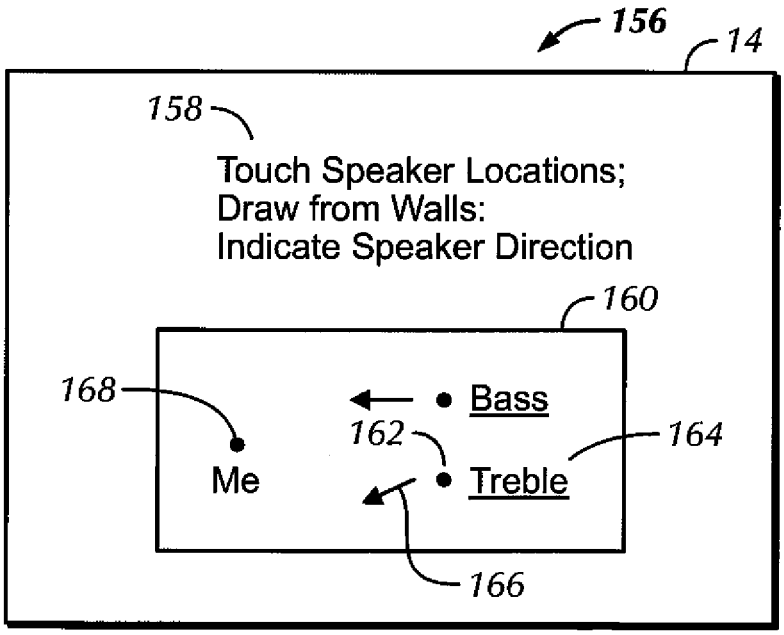

FIG. 5 shows an example UI 156 that may be presented on the CE device 12 according to discussion above related to states 92 and 118-122. The user is prompted 158 to touch speaker locations and trace as by a finger or stylus the enclosure 70 walls, and further to name speakers and indicate a target listener location. Accordingly, the user has, in the example shown, drawn at 160 the enclosure 70 boundaries and touched at 162 the speaker locations in the enclosure. At 164 the speaker has input speaker names of the respective speakers, in this case also defining the frequency and/or channel assignation desired for each speaker. At 166 the user has traced the direction of the sonic axis of each speaker, thereby defining the orientation of the speaker in the enclosure. At 168 the user has touched the location corresponding to a desired target listener location. These inputs are then used in the logic of FIGS. 2, 2A, 2B when executing the various waveform interference-based steps.

Figure 6:
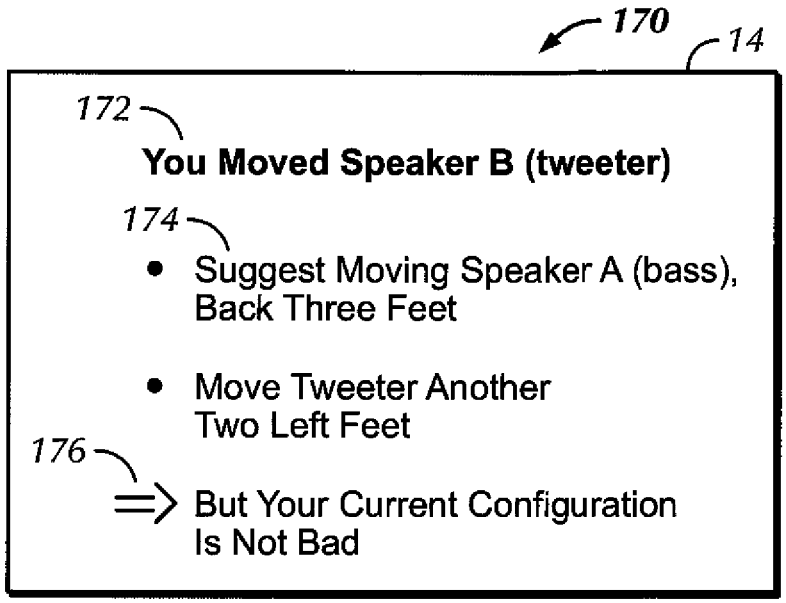

FIG. 6 shows an example UI 170 that may be presented on the CE device 12 according to discussion above related to state 104. A message 172 may be presented confirming to the user that he moved one or more speakers with one or more suggestions 174 presented regarding how to further optimize the speaker set up. A comment 176 may also be provided (if appropriate based on the waveform analysis) as to the qualitative evaluation of the user's new setup without following any of the suggestions 174. The quality may be based on the points alluded to above, e.g., for 2-4 rule-based points the configuration may be evaluated as "not bad", for >4 the evaluation may be "good", and for <2 the evaluation may be "not good" or "poor".

Figure 7:
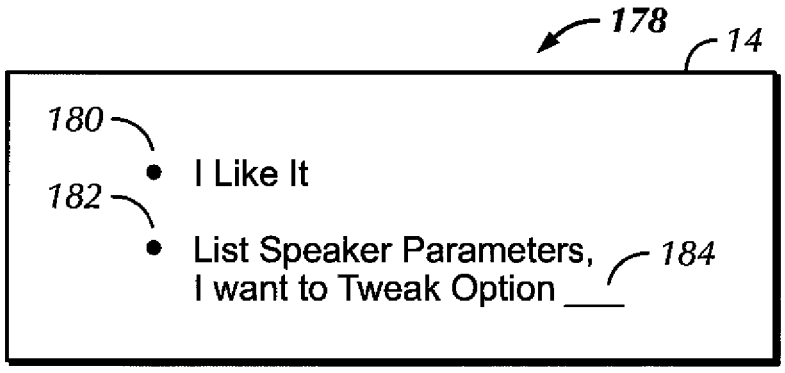
Figure 8:
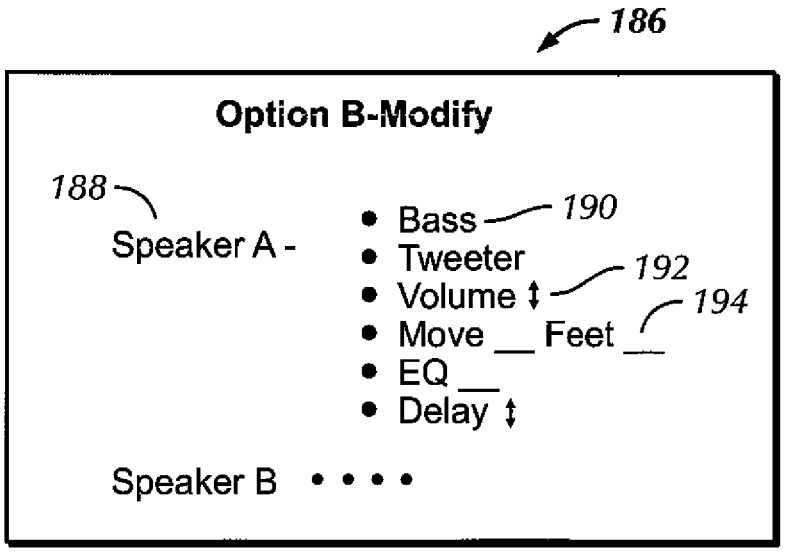

FIG. 7 shows an example UI 178 that may be presented on the CE device 12 according to discussion above related to states 106 and 108. The user may indicate at 180 that the current configuration is satisfactory (by, e.g., touching the display 14) or the user may indicate at 182 to list speaker parameters for a given one of the options 174 shown in FIG. 6. In this latter case a list of speaker parameters and/or positions and/or frequency assignations may be provided on another UI for the user to adjust individual settings accordingly. FIG. 8 shows an example of such as UI 186 that may be presented on the CE device 12. As indicated in FIG. 8, the user has chosen, as the target suggestion to modify, option B (the second option) shown in FIG. 6, with a list 188 of speakers and respective parameters 190 associated with each speaker that may be adjusted in the user appropriately manipulating up/down selector elements 192 and/or appropriately entering values into fields 194 indicating, for example, EQ levels, a direction and distance in which the respective speaker is sought to be moved, etc.

Figure 9:
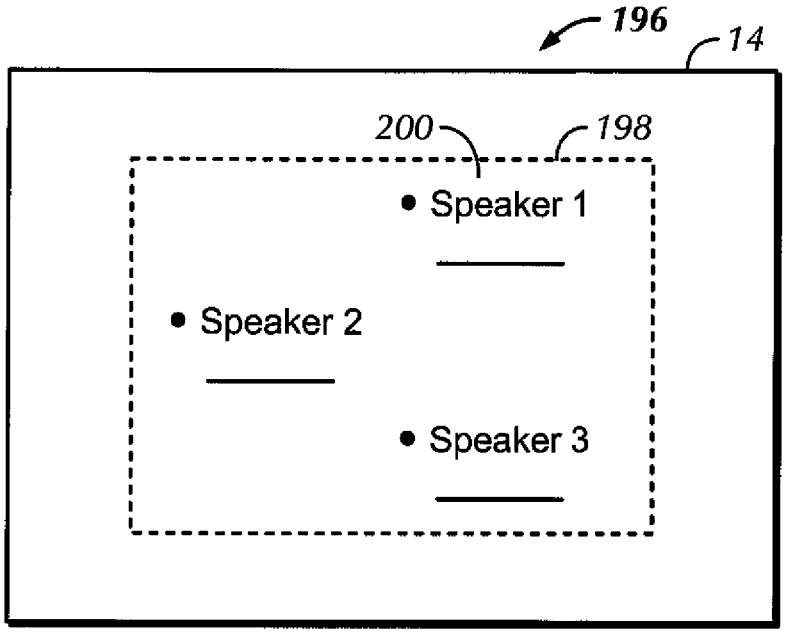

FIG. 9 shows an example UI 196 that may be presented on the CE device 12 according to discussion above related to state 118. As shown at 198, the boundary of the enclosure 70, determined according to one or more of the methods previously described, is presented on the display 14 along with locations 200 of the speakers, also determined according to previous disclosure. Fields are provided next to each generic speaker name into which a user can enter a user-defined speaker name, e.g., treble, bass, woofer, sub-woofer, left, right, surround, etc. In these latter cases the user-defined names may not only be presented next to the respective speakers in subsequently presented UIs, but may also be used by the processor executing the logic to assign frequency bands and/or channels to the speakers so designated, based on word recognition of the user-defined names.

Figure 10:
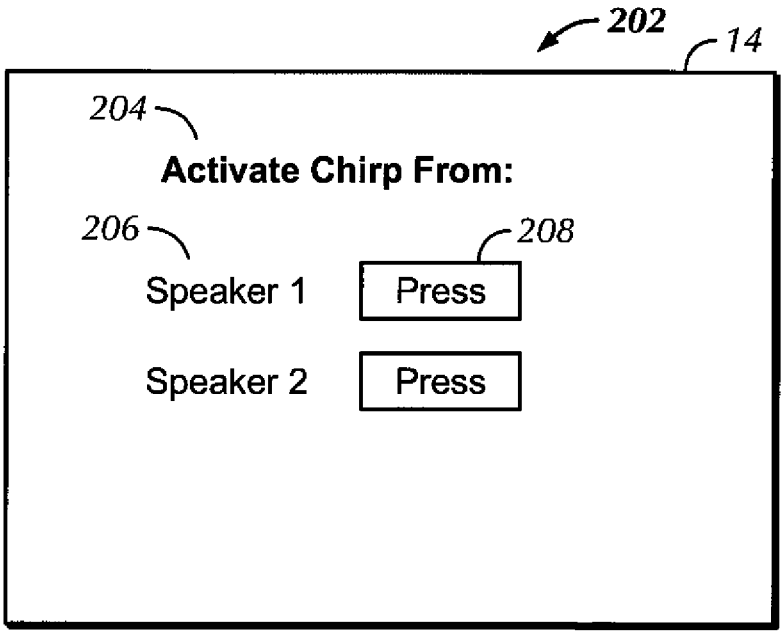

FIG. 10 shows an example UI 202 that may be presented on the CE device 12 according to discussion above related to state 136. The user is prompted 204 to activate a chirp from each speaker in a list 206 of speakers by selecting a respective chirp selector element 208, causing the respective speaker to emit a test chirp according to discussion above.

Figure 11:
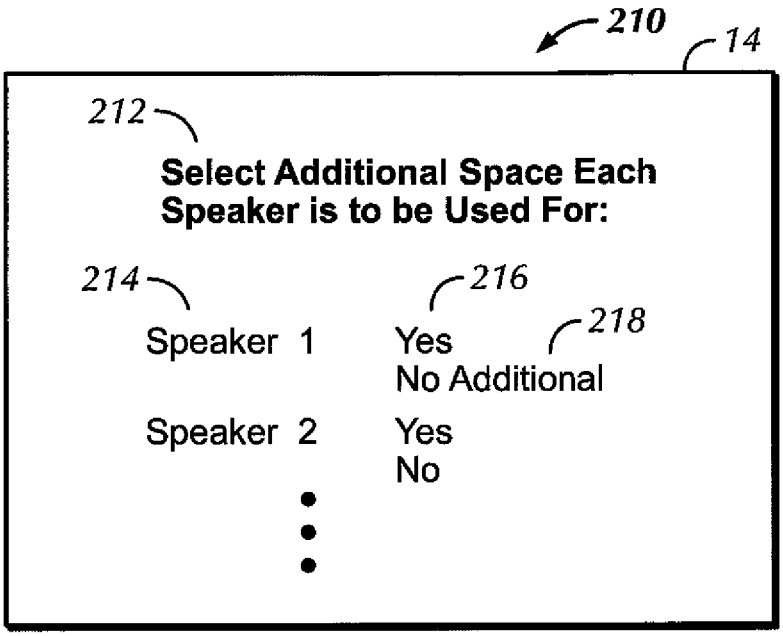

FIG. 11 shows an example UI 210 that may be presented on the CE device 12 according to discussion above related to state 144. The user is prompted 212 to select an additional space a speaker selected from a list 214 of speakers is to be used for. For each speaker in the list 214 the user may select 216 that the speaker will be used for an additional space, or the user may select a selector element 218 indicating that the speaker will be used for no additional spaces in addition to the enclosure 70.

Figure 12:
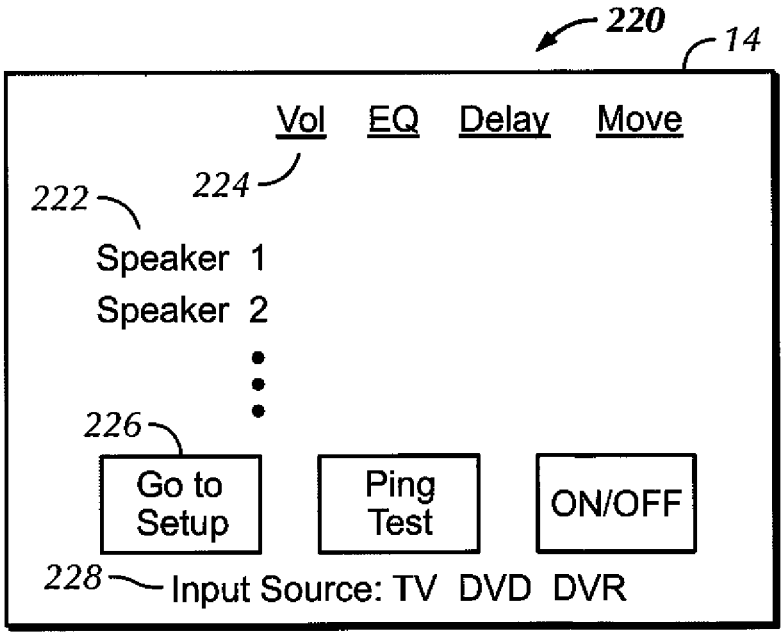

FIG. 12 shows an example speaker control interface UI 220 that may be presented on the CE device 12 according to discussion above related to ending the setup logic and transitioning into speaker control during operation of the audio system. The example non-limiting UI 220 may present a list 222 of speakers in the system and, in a row, a list 224 of speaker parameters for each speaker, for adjustment thereof by the user if desired. A setup selector element 226 may be provided selectable to allow the user to invoke the logic of FIGS. 2, 2A, 2B. Other selector elements may be provided to, e.g., initiate the chirp test of FIGS. 2, 2A, 2B and to toggle the audio system on and off, An input source selector 228 may be provided to select the source of audio input to the audio system, e.g., a TV source, a video disk source, a personal video recorder source.

A Wi-Fi or network connection to the server 60 from the CE device 12 and/or CPU 50 may be provided to enable updates or acquisition of the control application. The application may be vended or otherwise included or recommended with audio products to aid the user in achieving the best system performance. An application (e.g., via Android, iOS, or URL) can be provided to the customer for use on the CE device 12. The user initiates the application, answers the questions/prompts above, and receives recommendations as a result. Parameters such as EQ and time alignment may be updated automatically via the network.

While the particular DISTRIBUTED WIRELESS SPEAKER SYSTEM WITH AUTOMATIC CONFIGURATION DETERMINATION WHEN NEW SPEAKERS ARE ADDED is herein shown and described in detail, it is to be understood that the subject matter which is encompassed by the present invention is limited only by the claims.

What is claimed is:

1. A device comprising:

at least one computer memory that is not a transitory signal and that comprises instructions which when executed by at least one processor result in:

determining that one or more audio speakers are present on a network of audio speakers in a speaker arrangement, each speaker being associated with a respective network address so that each speaker may be addressed by a computer accessing the network;

receiving dimensions of at least one enclosure in which the network at least partially is disposed;

receiving at least a desired listening position and/or a number of listeners;

determining whether the speaker arrangement meets at least one acoustic requirement;

responsive to a determination that the speaker arrangement does not meet the acoustic requirement, indicating on a computerized display device that the speaker arrangement does not meet the acoustic requirement and prompting the user to adjust one or more of speaker location, orientation, frequency assignation, speaker parameters, or automatically adjusting one or more of frequency assignation, speaker parameters; and determining whether a basic setup is complete, and responsive to a determination that the basic setup is complete, launching a speaker control user interface on the display device.

2. The device of claim 1, wherein the instructions are executable for, responsive to a determination that the speaker arrangement meets the acoustic requirement, establishing at least one speaker delay and/or volume based at least in part on the speaker arrangement.

3. The device of claim 1, wherein the instructions are executable for, responsive to a determination that the basic setup is not complete, determining whether one or more measurement microphones are available, and responsive to determining that one or more measurement microphones are available, outputting an interface guiding a user through a measurement routine.

4. The device of claim 3, wherein the measurement routine includes causing at least one speaker to emit a test chirp, and determining a location of at least one speaker and/or at least one surface distanced from a speaker based at least in part on the test chirp.

5. The device of claim 1, wherein the instructions are executable for receiving user input respective labels for each speaker.

6. A device comprising:

at least one computer memory that is not a transitory signal and that comprises instructions which when executed by at least one processor configure the processor for:

determining that one or more audio speakers are present on a network of audio speakers in a speaker arrangement, each speaker being associated with a respective network address so that each speaker may be addressed by a computer accessing the network;

receiving dimensions of at least one enclosure in which the network at least partially is disposed;

receiving at least a desired listening position and/or a number of listeners;

determining whether the speaker arrangement meets at least one acoustic requirement;

responsive to a determination that the speaker arrangement does not meet the acoustic requirement, indicating on a computerized display device, via a user interface, that the speaker arrangement does not meet the acoustic requirement and prompting the user to adjust one or more of speaker location, orientation, frequency assignation, speaker parameters or automatically adjusting at least one speaker parameter; and determining whether at least one speaker is to be used for multiple spaces, and responsive to a determination that the at least one speaker is to be used for multiple spaces, controlling the computerized display device to present at least one user interface to guide a user through secondary assignments for the at least one speaker.

7. A device comprising:

at least one computer memory that is not a transitory signal and that comprises instructions which when executed by at least one processor result in:

determining that one or more audio speakers are present on a network of audio speakers in a speaker arrangement, each speaker being associated with a respective network address so that each speaker may be addressed by a computer accessing the network;

receiving dimensions of at least one enclosure in which the network at least partially is disposed;

accessing at least a desired listening position and/or a number of listeners;

determining whether the speaker arrangement meets at least one acoustic requirement;

responsive to a determination that the speaker arrangement does not meet the acoustic requirement, indicating, using a user interface presented on at least one computerized display device, that the speaker arrangement does not meet the acoustic requirement and prompting the user to adjust one or more of speaker location, orientation, frequency assignation, speaker parameters and/or automatically adjusting at least one speaker parameter;

wherein the determining whether the speaker arrangement meets at least one acoustic requirement is executed at least in part using wave interference analysis.

8. System comprising:

at least one computer readable storage medium bearing instructions executable by a processor which is configured for accessing the computer readable storage medium to execute the instructions to configure the processor for:

presenting on a display at least a first user interface (UI); and receiving from the first UI at least one user input, the first UI comprising:

an indication of a boundary of an enclosure for containing an audio speaker network; and indications of speaker locations within the boundary;

presenting a second UI comprising at least one prompt to select an additional space a speaker is to be used for in addition to the enclosure.

9. The system of claim 8, wherein the first UI includes indications of identities of speakers.

10. The system of claim 8, wherein the instructions when executed by the processor further configure the processor for presenting a third UI, the third UI including:

at least one prompt to activate at least one speaker to emit at least one test chirp.

11. The system of claim 10, wherein the at least one speaker is presented on the third UI as one of a group of speakers.

12. The system of claim 10, wherein at least the first, second, or third UI includes a chirp selector element selectable by a user to activate the speaker to emit the at least one test chirp.

13. The system of claim 8, wherein at least one of the UIs includes a selector selectable to indicate that a speaker will be used for no additional spaces in addition to the enclosure.

* * * * *